US011371185B2

(12) United States Patent
Jansson et al.

(10) Patent No.: US 11,371,185 B2
(45) Date of Patent: Jun. 28, 2022

(54) OUTLET SYSTEM FOR TRANSPORTING COMMINUTED LIGNOCELLULOSIC MATERIAL FROM A VESSEL AND VESSEL COMPRISING SUCH AN OUTLET SYSTEM

(71) Applicant: VALMET AB, Sundsvall (SE)

(72) Inventors: Roger Jansson, Karlstad (SE); Jonas Saetheråsen, Hammarö (SE); Jerk Söderman, Karlstad (SE); Magnus Wilhelmsson, Skoghall (SE)

(73) Assignee: VALMET AB, Sundsvall (SE)

( * ) Notice: Subject to any disclaimer, the term of this patent is extended or adjusted under 35 U.S.C. 154(b) by 0 days.

(21) Appl. No.: 17/287,185

(22) PCT Filed: Oct. 28, 2019

(86) PCT No.: PCT/SE2019/051059

§ 371 (c)(1),
(2) Date: Apr. 21, 2021

(87) PCT Pub. No.: WO2020/091659

PCT Pub. Date: May 7, 2020

(65) Prior Publication Data

US 2021/0309449 A1 Oct. 7, 2021

(30) Foreign Application Priority Data

Oct. 29, 2018 (SE) ..... 1851341-6

(51) Int. Cl.

| | |
|---|---|
| ***D21C 7/06*** | (2006.01) |
| ***B65D 88/28*** | (2006.01) |
| ***D21C 3/24*** | (2006.01) |
| ***D21C 3/26*** | (2006.01) |

(52) U.S. Cl.
CPC ..... *D21C 7/06* (2013.01); *B65D 88/28* (2013.01); *D21C 3/24* (2013.01); *D21C 3/26* (2013.01)

(58) Field of Classification Search
CPC ..... B65D 88/28; D21C 7/06
USPC ..... 162/246
See application file for complete search history.

(56) References Cited

U.S. PATENT DOCUMENTS

| | | | |
|---|---|---|---|
| 2,943,752 | A | 7/1960 | Platt |
| 4,958,741 | A | 9/1990 | Johanson |
| 5,622,598 | A | 4/1997 | Prough |
| 5,700,355 | A | 12/1997 | Prough |
| 6,325,890 | B1 | 12/2001 | Prough et al. |

(Continued)

FOREIGN PATENT DOCUMENTS

| | | | |
|---|---|---|---|
| RU | 2469142 | C2 | 1/2010 |
| WO | WO-2012/102650 | A1 | 8/2012 |
| WO | WO-2014/142724 | A1 | 9/2014 |

OTHER PUBLICATIONS

Velodyne, What is a Screw Conveyor?, May 21, 2016. (Year: 2016).*

(Continued)

*Primary Examiner* — Anthony Calandra
(74) *Attorney, Agent, or Firm* — Foley & Lardner LLP

(57) ABSTRACT

The present invention relates to an outlet system for transporting comminuted lignocellulosic material from a vessel, said bottom portion (1) having an upper circumference (15) that is essentially circular and a lower circumference (16) comprising at least two essentially straight portions (16*a*, 16*c*) opposite each other. The invention also relates to a vessel having such an outlet system.

11 Claims, 7 Drawing Sheets

(56) References Cited

U.S. PATENT DOCUMENTS

Figure 1:
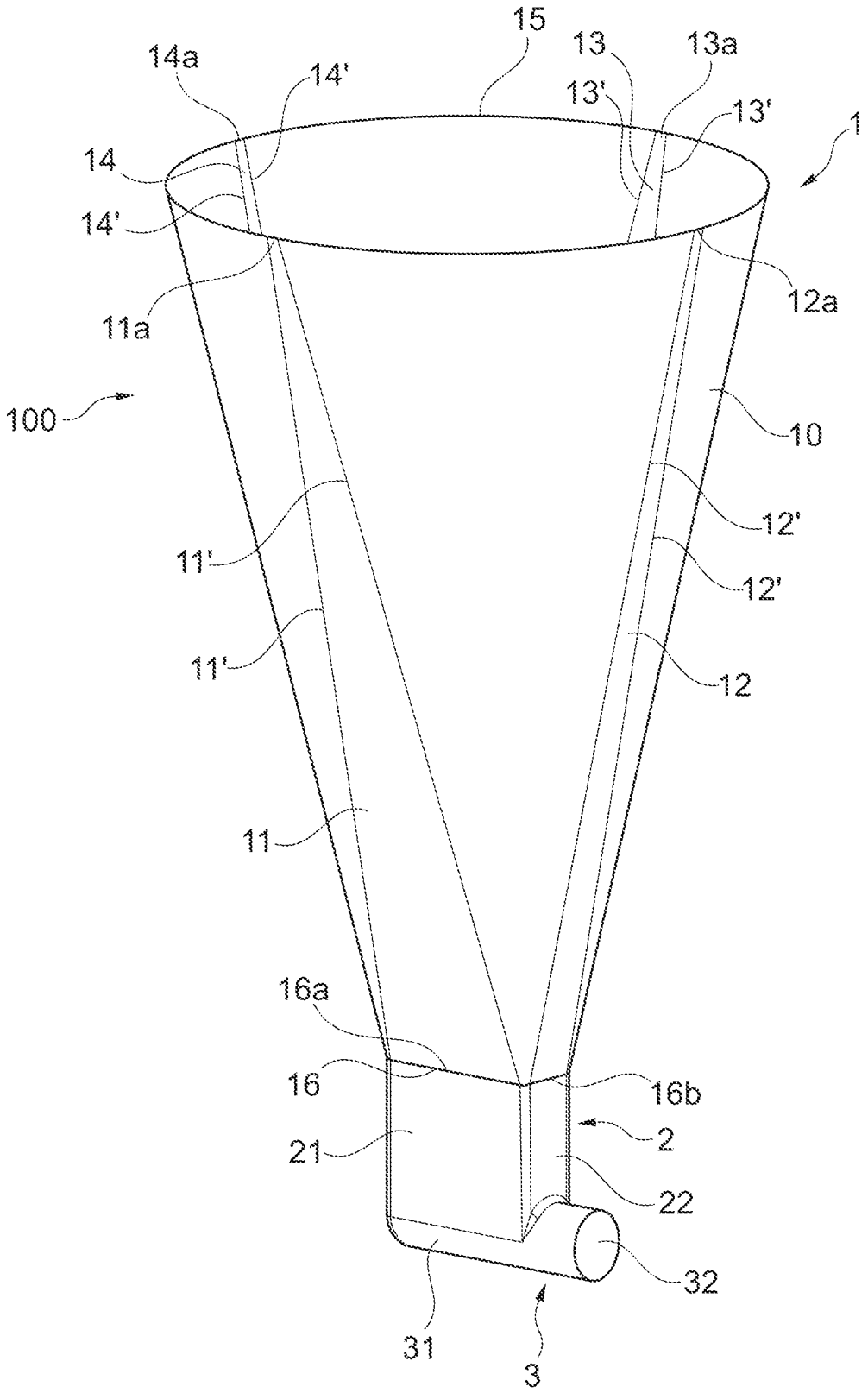

| | | | |
|---|---|---|---|
| 2001/0025694 | A1 | 10/2001 | Kettunen et al. |
| 2005/0279468 | A1 | 12/2005 | Stromberg |
| 2009/0020244 | A1 | 1/2009 | Stromberg |
| 2016/0040355 | A1 | 2/2016 | Patrik et al. |

OTHER PUBLICATIONS

Swedish Search Report, Application No. 1851341-6, dated Apr. 9, 2019, 3 pages.
Russian Search Report and English translation, Application No. 2021114693, dated Sep. 30, 2021, 4 pages.
Supplementary European Search Report, Application No. 19879313, dated Nov. 4, 2021, 3 pages.

* cited by examiner

OUTLET SYSTEM FOR TRANSPORTING COMMINUTED LIGNOCELLULOSIC MATERIAL FROM A VESSEL AND VESSEL COMPRISING SUCH AN OUTLET SYSTEM

TECHNICAL FIELD

The present invention relates to an outlet system for transporting comminuted lignocellulosic material from a vessel, said outlet system comprising a bottom portion arranged in or at a bottom portion of the vessel. The invention also relates to a vessel having an outlet system.

BACKGROUND

In traditional systems for feeding comminuted cellulosic fibrous materials from, for example, a pretreatment vessel to a digester, the feeding system comprised a low-pressure feeder, typically arranged and disposed below the pretreatment vessel for feeding the comminuted cellulosic fibrous material from the pretreatment vessel to a high-pressure feeder, which transferred the cellulosic material to the digester. In those systems, the high-pressure feeder represented a high-capital cost equipment, which also required significant and regular maintenance.

In the U.S. Pat. No. 6,325,890 to Prough et al., it is disclosed how a high-pressure feeder advantageously can be replaced with one or more pumps located at least thirty feet below the top of a treatment vessel and being configured for pressurizing a slurry of wood chips, which have been steamed in a steaming vessel, to a pressure of at least 10 bar. The slurry is thereby discharged from the steaming vessel to a chip metering device, which, in turn, may be connected to a low-pressure feeder, and therefrom via a conduit to the one or several pumps, whereby it is stated in the patent document that the conduit preferably is a "Chip Tube" sold by the company Ahlstrom Machinery.

To replace a high-pressure feeder with one or several pumps as suggested in the aforementioned patent is favorable from many aspects, and in the pulping industry there is today an ongoing trend to make such a replacement. However, in order for the chip slurry to be transported to the pump an outlet system is required that allows for an even and efficient movement. Existing outlet systems are not suited to this purpose, creating a need for replacement of entire treatment vessel in order for a pump to be connected.

One problem associated with the prior art is that the outlet of the chip slurry from the vessel is uneven. This can be solved through providing a bottom scraper that rotates along the bottom of the vessel to facilitate movement towards an outlet opening, but such solutions have the disadvantage that the movable mechanical parts of the bottom scraper are subjected to wear and tear and require maintenance and replacement.

There is therefore a need for an improved outlet system that does not rely on a movable scraper and that allows for an efficient outlet of chip slurry without plugging the outlet to enable an even movement of the slurry.

SUMMARY OF THE INVENTION

The object of the present invention is to eliminate or at least to minimize the problems mentioned above. This is achieved through an outlet system according to the appended independent claim. Particularly advantageous features of the invention are set out in the dependent claims.

The invention also comprises a vessel for treatment of lignocellulosic material having such an outlet system, and the invention further comprises a method for modifying a vessel for treatment of comminuted lignocellulosic material by replacing a bottom portion with an outlet system according to the present invention.

Thus, the outlet system according to the invention comprises a bottom portion arranged in or at a bottom portion of the vessel, said bottom portion having an upper circumference that is essentially circular and a lower circumference comprising at least two essentially straight portions opposite each other. Further, the outlet system comprises a chip transfer arrangement that is joined to the lower circumference and comprises sides that correspond to sides of the lower circumference, and the outlet system also comprises an outlet unit that is joined to the chip transfer arrangement and that comprises an outlet that is configured to be connected to a pump, wherein the outlet further has a circular cross-section.

Thereby, the transport of lignocellulosic material from the vessel towards the pump is facilitated. According to the invention, each of the essentially straight portions forms a base for a wedge-shaped surface on a lateral surface of the bottom portion, said wedge-shaped surface being planar and extending upwards to an upper wedge end at the upper circumference. Thereby, the transport of lignocellulosic material from the vessel towards the pump is further facilitated and the wedge-shaped surfaces allow for the efficient and even movement of chip slurry. It has surprisingly been found that two wedge-shaped surfaces on the lateral surface of the bottom portion is enough for the feeding of chip slurry to be significantly improved.

The invention provides the significant advantage that the comminuted lignocellulosic material is transported from the vessel to the outlet without needing mechanical stirring through a scraper or similar. In many prior art systems, there is a risk that material gets stuck unless constant stirring is provided in order to keep the material moving and transporting it towards an outlet. For the present invention on the other hand, using the bottom portion with the wedge-shaped surfaces together with the chip transfer arrangement and the outlet unit, the material is transported efficiently and with lower energy consumption since no scraper is needed.

The invention is also advantageous in allowing for the efficient transport of lignocellulosic material that has a high fluid content. This is especially the case when using one vessel for both steaming and impregnation, since the resulting slurry of lignocellulosic material after these treatments is in the form of a fluid that is very well suited to pumping.

According to another aspect of the invention, the upper wedge end of at least one of the wedge-shaped surfaces is offset in a circumferential direction from a middle point on the base of the wedge-shaped surface. Thereby the shape of the bottom portion is rendered asymmetrical and a build-up of chip slurry in any one part of the bottom portion is avoided.

According to another aspect of the invention, the wedge-shaped surfaces are at a first angle with respect to a plane that coincides with the essentially circular upper circumference of the bottom portion, said first angle being equal to or less than 120 degrees, preferably less than 115 degrees. Thereby, movement of the chip slurry towards the outlet is also improved and the risk of chip slurry buildup at any point along the bottom portion is decreased.

According to yet another aspect of the invention, the lower circumference is essentially rectangular in shape, comprising four essentially straight portions. Thereby, the shape of the bottom portion is gradually altered from a circular cross-section to a rectangular cross-section to fit with available chip chutes or chip transfer arrangements that move chip slurry along towards the pump.

According to a further aspect of the invention, the lateral surface of the bottom portion comprises at least four wedge-shaped surfaces, each having one of the essentially straight portions as its base. Thereby, efficient and even movement of the chip slurry is even further improved.

According to the invention, the outlet unit may suitably comprise a conduit that connects the outlet to the outlet unit. Thereby, the outlet can be separated from the rest of the outlet system by a conduit of suitable length, so that a pump can be connected to the outlet at a distance from the outlet system and the comminuted lignocellulosic material can be transported to that pump through the conduit. This is especially advantageous when the material is to be transported into a second vessel that is at a distance from the vessel where the outlet system is provided.

The outlet system may suitably comprise a pump that is connected to the outlet of the outlet system, and that pump may advantageously be a centrifugal pump. This allows for the material to be transported out of the vessel where the outlet system is provided and to the pump for pumping to another vessel where further treatment of the material is to take place.

Suitably, the outlet system may also comprise at least one nozzle arranged to supply a fluid into the outlet unit. This has the advantage that additional fluid may be supplied into the outlet unit to keep the flow of material steady as desired and to prevent clogging or undesired retaining of material in any part of the outlet unit.

The connection portion of the outlet unit may suitably extend in a direction that is that is +15° to −45° in relation to a horizontal direction, preferably +5° to −20° to a horizontal direction. Thereby, the outlet system and especially the chip transfer arrangement and the outlet unit can be made smaller while still being able to transport the lignocellulosic material towards the outlet in an efficient way. It is especially advantageous that the outlet system can be made more compact and space efficient. This advantage is especially large in the smaller range of +5° to −20° in relation to a horizontal direction but will also arise to some degree in the larger interval. Depending on available space and the orientation and placement of conduits and vessels connected with further treatment of lignocellulosic material, the orientation of the connection portion from the outlet system may be adjusted to achieve the most compact and convenient pulping process.

According to the invention, there is also provided a vessel for treatment of comminuted lignocellulosic material, the vessel comprising an outlet system according to the present invention. Preferably, the bottom portion is integrated with the vessel, but alternatively the vessel can comprise an upper portion to which the bottom portion of the outlet system is joined.

The invention also has a significant advantage over the prior art in that an existing treatment vessel can be modified by replacing the bottom of the vessel with an outlet system according to the present invention. Thereby, the need for replacing the whole treatment vessel can be eliminated.

Many additional benefits and advantages of the invention will become readily apparent to the person skilled in the art in view of the detailed description below.

DRAWINGS

Figure 2C:
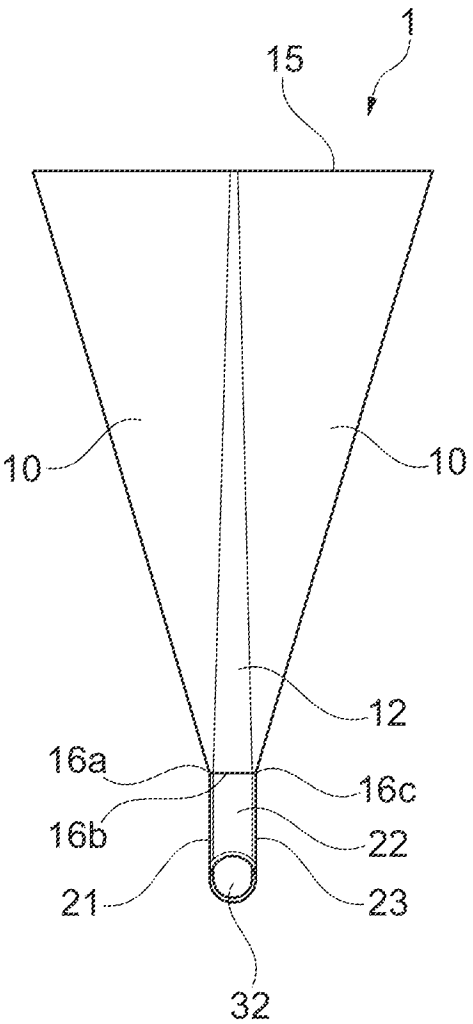
Figure 2B:
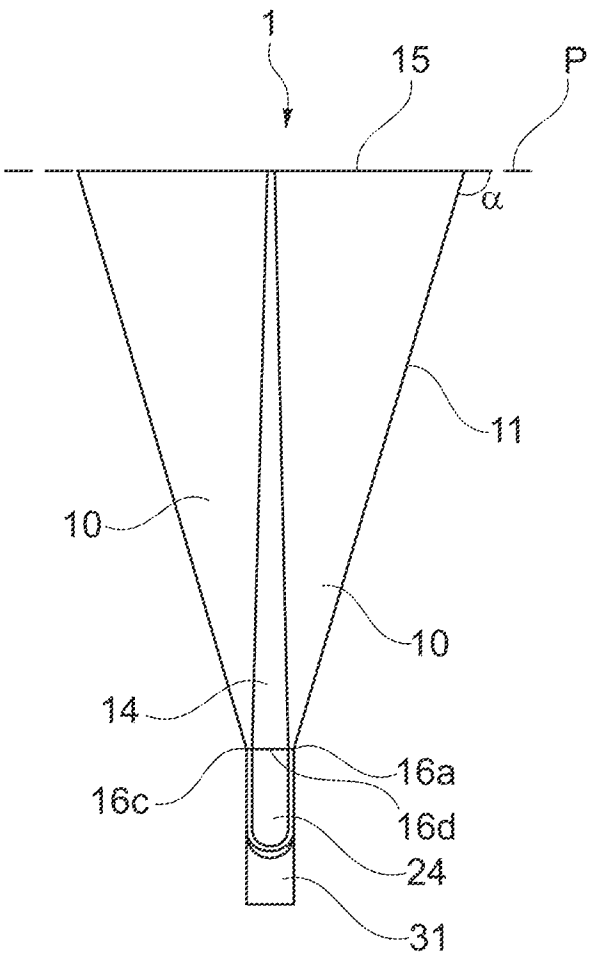
Figure 2A:
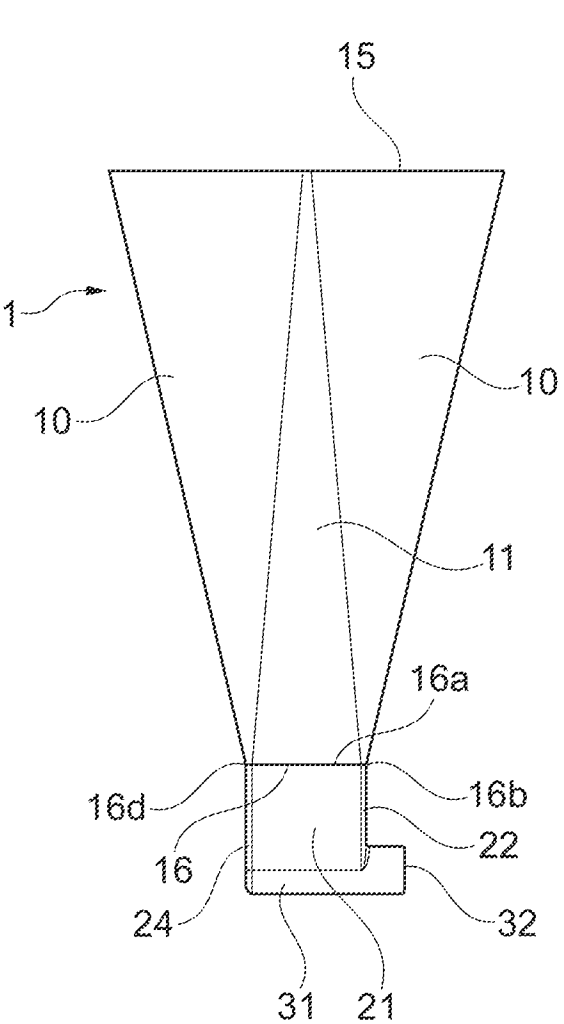
Figure 3C:
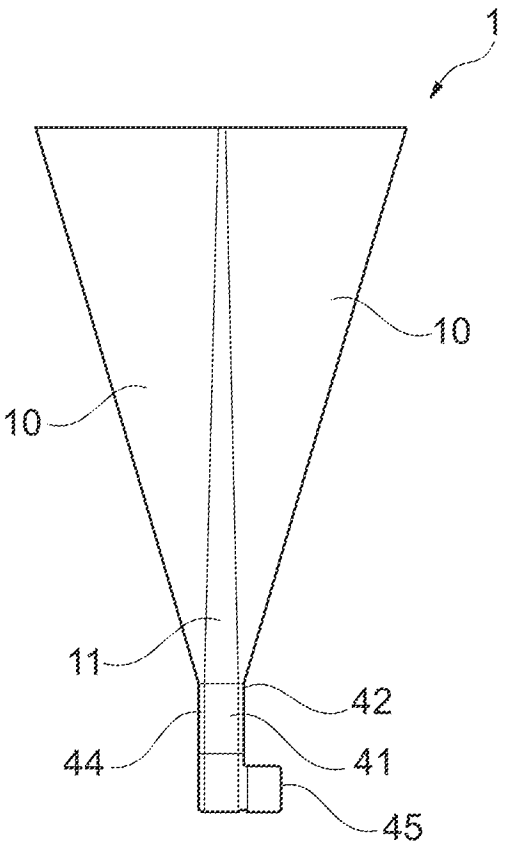
Figure 3B:
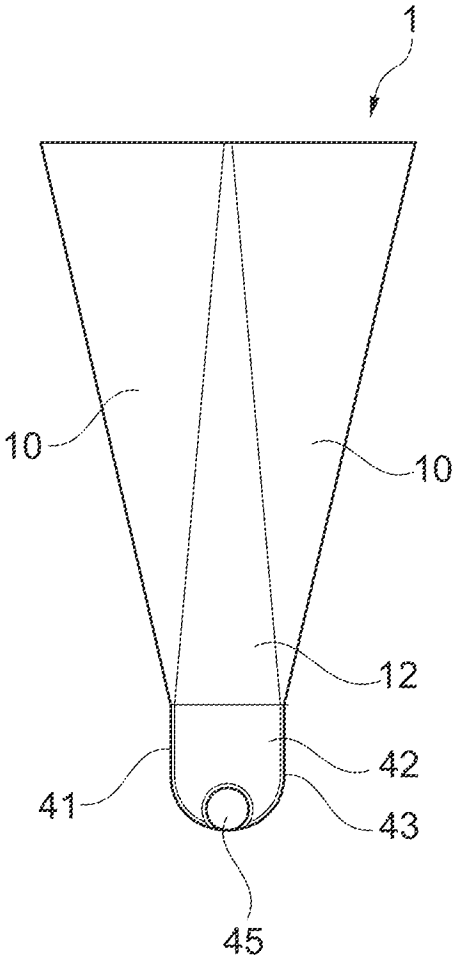
Figure 3A:
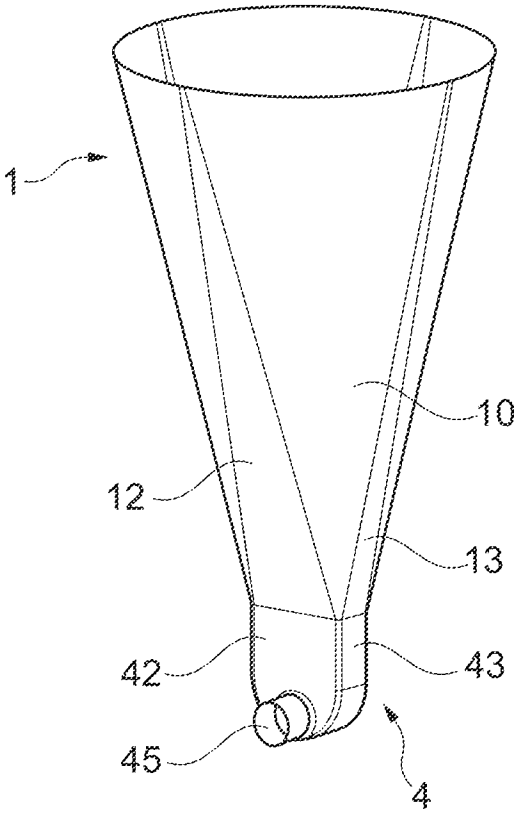

The invention will now be described in more detail with reference to the appended drawings, wherein FIG. 1 discloses a perspective view of an outlet system according to a preferred embodiment of the present invention;

FIG. 2*a* discloses a planar view from the side of the outlet system of FIG. 1;

FIG. 2*b* discloses a planar view from the back of the outlet system of FIG. 1;

FIG. 2*c* discloses a planar view from the front of the outlet system of FIG. 1;

FIG. 3*a* discloses a perspective view of a second embodiment of the invention;

FIG. 3*b* discloses a planar view from the front of the second embodiment of FIG. 3*a;*

FIG. 3*c* discloses a planar view from the side of the second embodiment of FIG. 3*a;*

Figure 4:
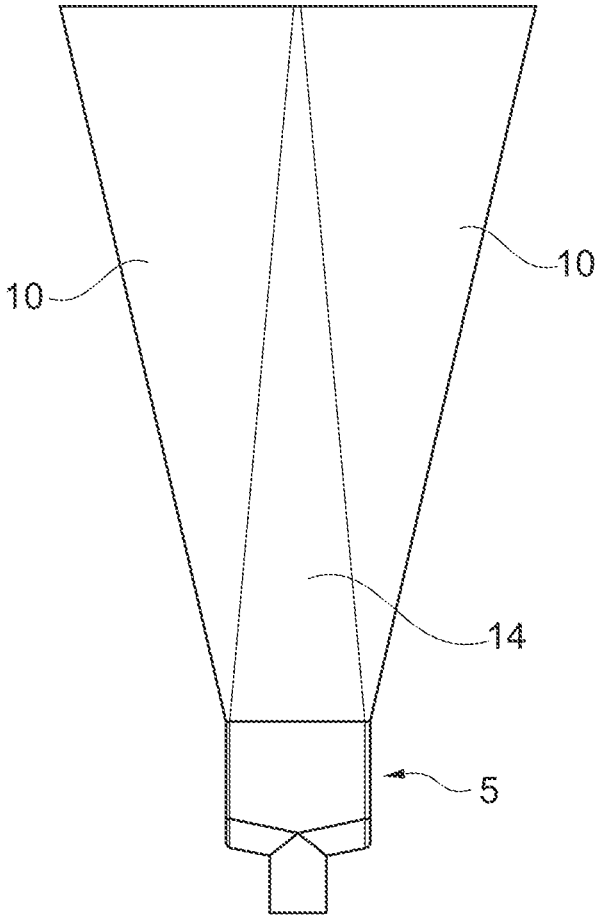
Figure 5A:
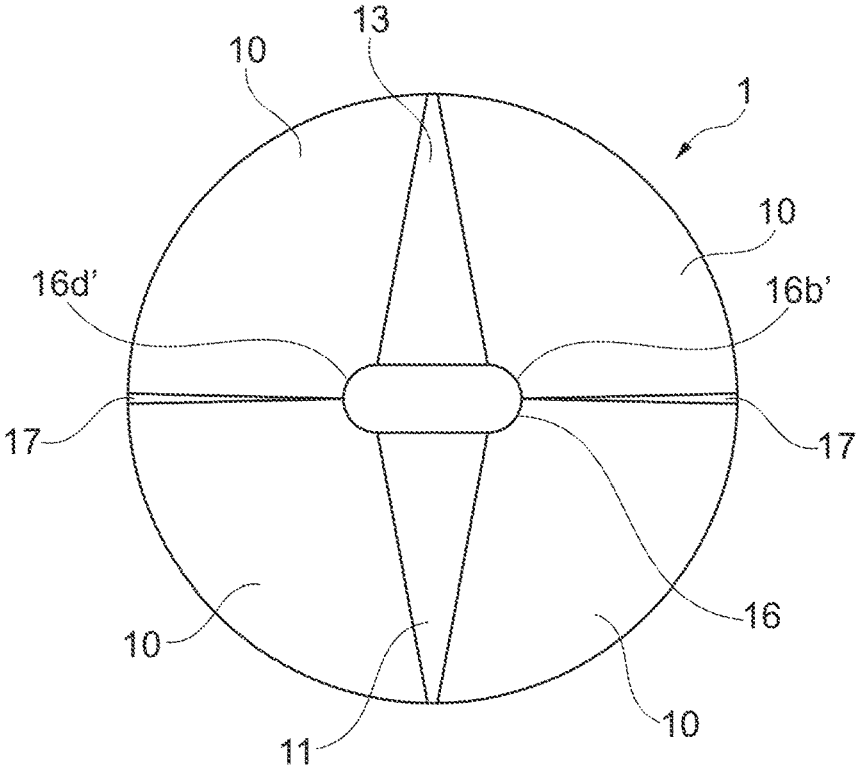
Figure 5B:
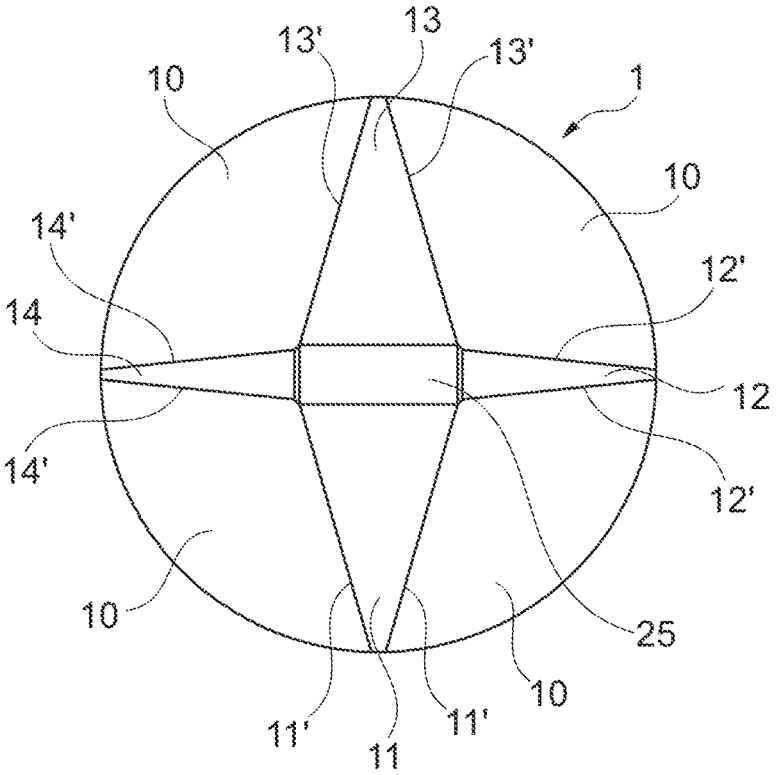
Figure 6A:
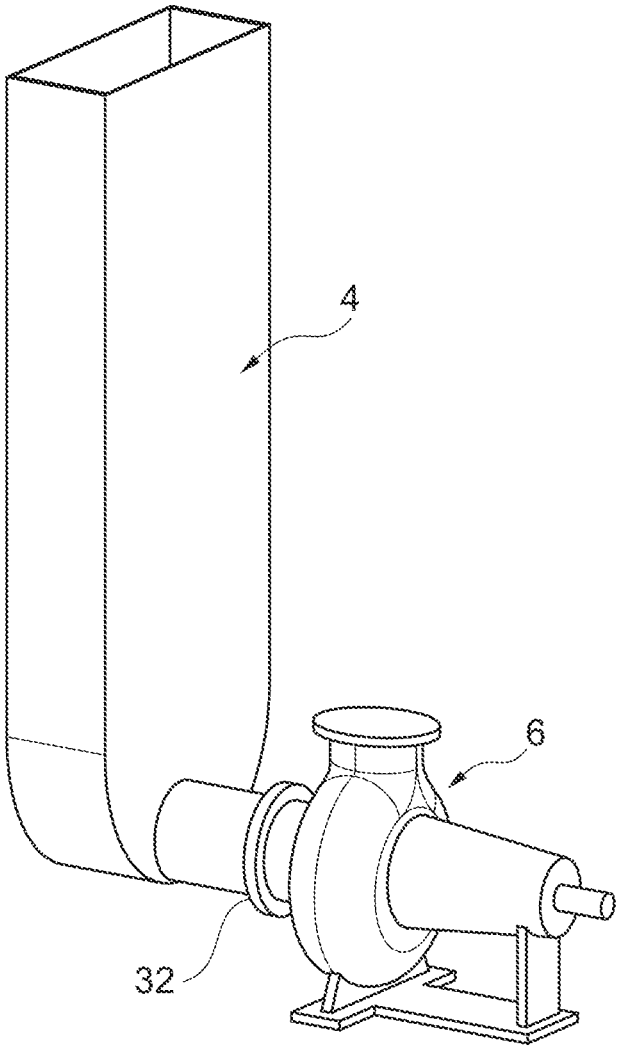
Figure 6B:
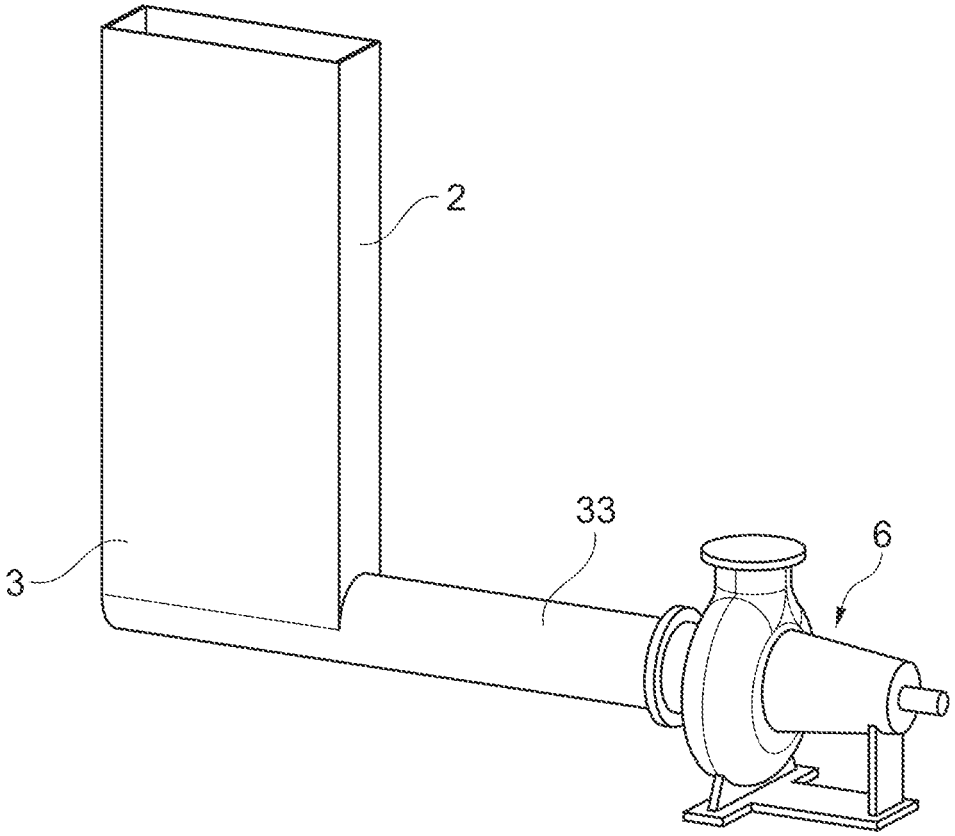

FIG. 4 discloses a planar view from the back of a third embodiment of the invention;

FIG. 5*a* discloses a planar view from above of a fourth embodiment of the invention;

FIG. 5*b* discloses a planar view from above of the first embodiment of FIG. 1;

FIG. 6*a* discloses a perspective view of the chip transfer arrangement and outlet unit of FIG. 3*a*-3*c* with a pump connected to the outlet; and FIG. 6*b* discloses a perspective view of the chip transfer arrangement and outlet unit of FIG. 1 and FIG. 2*a*-2*c* with a conduit and a pump connected to the outlet.

DETAILED DESCRIPTION

The present invention relates generally to an outlet system for feeding comminuted cellulosic fibrous material from a first vessel to a second vessel by means of at least one pump. The comminuted cellulosic fibrous material is typically wood chips, which can have been diluted with liquid, e.g. water, or which are diluted with liquid, e.g. water, in the outlet system itself, e.g. in the first vessel or in a chip chute connected to the first vessel, but the outlet system can be applied also for other types of cellulosic materials. The first vessel can be a vessel for pretreatment of the wood chips (or other cellulosic materials), such as a steaming vessel or a chip bin, while the second vessel can be a continuous digester, a batch digester, an impregnation vessel or a hydrolysis or prehydrolysis vessel, but also other types of vessels with other purposes are conceivable. (The second vessel is, however, not part of an outlet system according to the invention and also does not interact directly with the outlet system.) Generally, at least one pump is arranged below the first vessel, and the comminuted cellulosic material is transported from the first vessel to the pump, either via a connection directly from an outlet provided in or at a bottom portion of the first vessel or via a chip chute. In some cases, there is, however, a need for arranging other devices between the first vessel and the pump. One example of such devices is a metering device, which measures the material or media flow from the first vessel. Another example of such a device is a portion of an existing chip chute which has previously been used in connection with, for example, a high-pressure feeder. As stated below, herein, all such devices or arrangements can be referred to as a "chip transfer arrangement". Such a chip transfer arrangement is suitable for connecting to an outlet system according to the present invention, but may in some embodiments form part of the outlet system as set out in more detail below. Below, the first vessel is referred to simply as a vessel, since a second vessel does not form part with or interact directly with the present invention.

As used herein, the term "chip transfer arrangement" thus includes all equipment, devices and arrangements which are arranged between a vessel and a pump and to which a bottom portion of the vessel connects. Examples of such equipment, devices and arrangements are a metering device or simply an outlet provided in the bottom portion of the vessel; or a "chip transfer arrangement" can be an existing rectangular chip chute or a portion of a previously arranged rectangular chip chute. Further, it should be understood that an outlet system for feeding comminuted cellulosic materials can be used for feeding of comminuted cellulosic materials that have been diluted with liquid. Such dilution can have taken place before the cellulosic material enters the outlet system of the invention, or the dilution can be done within the outlet system, e.g. in the vessel or in the chip chute. Thus, the term "comminuted cellulosic material" includes comminuted cellulosic material that has been diluted with liquid.

FIG. 1 and FIG. 2*a*-2*c* disclose an outlet system 100 according to a preferred embodiment of the invention, the outlet system 100 comprising a bottom portion 1 of a vessel, the bottom portion being configured to be joined to a chip transfer arrangement 2 that at its lower end is connected to an outlet unit 3 that is in turn configured to be connected via an outlet 32 to a pump (see FIG. 6*a*-6*b*). The bottom portion 1 is provided for outlet of comminuted lignocellulosic material that in the following will be referred to as chip slurry.

The vessel itself may have a conventional design and structure that is already well known within the art. It is therefore to be understood that the bottom portion 1 forms the vessel together with at least an upper portion and that the bottom portion 1 may be joined to said upper portion (or to a middle portion that in turn is connected to the upper portion), or alternatively that the bottom portion 1 forms an integrated part of the vessel.

The bottom portion 1 has an upper circumference 15 that preferably has an essentially circular cross-section and a lower circumference 16 that comprises at least two essentially straight portions 16*a* that are opposite each other, i.e. that are essentially parallel to each other and do not coincide. In the preferred embodiment, the lower circumference 16 comprises four straight portions 16*a*, 16*b*, 16*c*, 16*d* that form two pairs of straight portions that are opposite each other so that the four straight portions 16*a*, 16*b*, 16*c*, 16*d* form a rectangle. This can also be seen as the bottom portion 1 having a rectangular shape at the lower circumference. The lower circumference 16 and the upper circumference 15 are connected by a lateral surface 10. Each of the straight portions 16*a*, 16*b*, 16*c*, 16*d* form a base for a wedge-shaped surface 11, 12, 13, 14 that is planar and extends from the lower circumference 16 towards the upper circumference 15 where each wedge-shaped surface 11, 12, 13, 14 ends in an upper wedge end 11*a*, 12*a*, 13*a*, 14*a*. The lateral surface 10 is as already mentioned essentially circular at the upper circumference 15 and tapers towards the lower circumference 16 so that a cross-sectional area of the lower circumference 16 is smaller than a cross-sectional area of the upper circumference 15. In the preferred embodiment the lateral surface 10 is essentially cone shaped in those portions that do not form part of any of the wedge-shaped surfaces 11, 12, 13, 14, such portions in the following being referred to as rounded portions.

Each of the wedge-shaped surfaces 11, 12, 13, 14 is connected on either side along a connection curve 11', 12', 13', 14' to a rounded surface and the connection curve 11' 12', 13', 14' can be in the form of a straight line but can alternatively have another shape that connects the base 16*a*, 16*b*, 16*c*, 16*d* and the upper wedge end 11*a*, 12*a*, 13*a*, 14*a*.

The arrangement of wedge-shaped surfaces 11, 12, 13, 14 on the lateral surface 10 of the bottom portion 1 improves a transport of chip slurry from the vessel towards the bottom circumference 16 of the bottom portion 1, especially since the connection curves 11', 12', 13', 14' assist in providing a uniform output of chip slurry and prevent creation of areas in the vessel where chip slurry remains so that pockets of remaining chip slurry are formed.

The wedge-shaped surfaces 11, 12, 13, 14 extend at a first angle $\alpha$ with respect to a plane P that coincides with the cross-section of the upper circumference 15, as shown in FIG. 2*b*. The first angle is equal to or less than 120 degrees, preferably about or less than 115 degrees. In embodiments where the bottom circumference 16 is rectangular, it is advantageous that the first angle $\alpha$ between the plane P and the wedge-shaped surfaces is larger for the wedge-shaped surfaces on the long sides of the rectangle and smaller for the wedge-shaped surfaces on the short sides of the rectangle. Preferably, the first angle $\alpha$ is about 120 degrees or less for the wedge-shaped surfaces on the long sides of the rectangle whereas the first angle $\alpha$ is about 110 degrees or less for the wedge-shaped surfaces on the short sides of the rectangle, preferably about 105 degrees or less. The plane P is essentially horizontal when the bottom portion 1 is mounted on a vessel. From this follows that the angle between the wedge-shaped surfaces and a vertical plane is maximum 30 degrees, preferably about 25 degrees. If the bottom circumference 16 is rectangular, the angle between the wedge-shaped surfaces on the short side of the rectangle and the vertical plane is preferably 20 degrees or less, more preferably 15 degrees or less.

The chip transfer arrangement 2 is joined to the lower circumference 16 and comprises sides 21, 22, 23, 24 that correspond to sides of the lower circumference 16 where bases for the wedge-shaped surfaces 11, 12, 13, 14 are formed. Inside the chip transfer arrangement 2 means may be provided for feeding the chip slurry towards the outlet unit 3, or alternatively the chip transfer arrangement 2 may be only a chute that connects the bottom portion 1 to the outlet unit 3.

The outlet unit 3 comprises a connection portion 31 that is joined to a lower end of the chip transfer arrangement 2 and an outlet 32 that is connectable to a pump. The outlet 32 in this embodiment has an essentially circular cross-section in order to connect to a pump having an inlet of the same shape, but it is possible for other types of pumps to provide the outlet 32 with another shape.

FIG. 3*a*-3*c* disclose another embodiment wherein the chip transfer arrangement and the outlet unit are combined to form an integrated outlet unit 4 having sides 41, 42, 43, 44 that correspond to the wedge-shaped surfaces 11, 12, 13, 14 and also having an outlet 45 that is connectable to the pump. This embodiment differs from the preferred embodiment above mainly in the shape of the integrated outlet unit 4 and the lower circumference 16 of the bottom portion 1 is adapted to fit an upper circumference of the integrated outlet unit 4.

FIG. 4 discloses an alternative embodiment wherein the chip transfer arrangement and the outlet unit are combined to form an alternative integrated outlet unit 5 that differs from the integrated outlet unit 4 above mainly in a shape that more efficiently feeds the chip slurry towards the outlet.

FIG. 5*b* shows the preferred embodiment of FIGS. 1 and 2*a*-2*c* from above, where the wedge-shaped surfaces 11, 12, 13, 14 and the curves 11', 12', 13', 14' that form their borders towards the rounded surfaces of the lateral surface 10 can clearly be seen, as well as an inner space 25 of the chip transfer arrangement 2.

FIG. 5*a* discloses another alternative embodiment where only two straight portions of the lower circumference 16 are provided so that the shape of the lower circumference 16 is rounded at sides 16*b*' and 16*d*'. In this embodiment, thin wedge-shaped surfaces 17 are provided on the lateral surface 10 on the rounded sides 16*b*', 16*d*' and have their base on the upper circumference 15, but alternatively this embodiment could have only two wedge-shaped surfaces 11, 13, each connected at its base to the essentially straight portions of the lower circumference 16.

FIG. 6*a* discloses the chip transfer arrangement 2 and outlet unit 3 in the form of a combined outlet unit 4 as described above with reference to the second embodiment of FIG. 3*a*-3*c*. A pump 6 is connected to the outlet 32 in order to pump the comminuted lignocellulosic material from the outlet system to another vessel for further treatment. The pump is preferably a centrifugal pump.

FIG. 6*b* discloses the chip transfer arrangement 2 and outlet unit 3 of the preferred embodiment of FIG. 1 and FIG. 2*a*-2*c*, with a conduit 33 provided in the outlet unit 3 so that the pump 6 can be connected to the outlet 32 at a distance from the vessel in connection with which the outlet system 1 is arranged.

The arrangement of the pump 6 shown in FIG. 6*a*-6*b* may be provided with any of the embodiments described herein and would be arranged in a similar way regardless of the embodiment concerned since the pump 6 would for each of them be connected to the outlet 32 from the outlet unit 3, 4, 5. Similarly, the conduit 33 may be arranged in any of the embodiments described herein.

The outlet system of the present invention has the advantage that only one pump 6 is needed to transport the material to a subsequent vessel. The need for a plurality of pumps arranged in series can therefore be avoided.

In another alternative embodiment the bottom portion 1 can have an asymmetrical cross-section between the upper and the lower circumference 15, 16 that is particularly efficient in transporting chip slurry from the vessel. Such asymmetrical cross-section is preferably realized through an upper wedge end of at least one of the wedge-shaped surfaces being offset in a circumferential direction from a middle point on the base of that wedge-shaped surface. In some embodiments, more than one of the wedge-shaped surfaces can have an upper wedge end that is offset in relation to the base, enabling a design of the lateral surface 10 that is asymmetrical and adapted for a particular application to provide an optimal output of chip slurry from the vessel.

As mentioned above, additional fluid may be added in the chip transfer arrangement 2 or in the outlet unit 3 in order to support the flow of material or to adjust the fluid content in the material. In some embodiments, fluid may be supplied through at least one fluid nozzle provided in the outlet unit 3. This has the particular advantage that clogging of material in the outlet unit 3 or blockage in the outlet unit 3 and the conduit 33 can be dissolved by adding fluid, or alternatively can be avoided completely by constantly adjusting the fluid content to keep a flow of material steady. In one embodiment, the connection portion 31 of the outlet unit 3 may instead protrude in the outlet system in a direction that is +15° to −45° in relation to a horizontal direction, preferably +5° to −20° to a horizontal direction. This means that the feeding of lignocellulosic material in the outlet system towards the outlet 32 may take place in a direction that varies from an upward angle of 15° from a horizontal axis to a downward angle of 45° from the horizontal axis, or preferably from an angle upwards of 5° to a downward angle of 20°. It is preferable to provide the connecting portion 31 extending within the smaller interval of +5° to −20° but the advantage may to some extent also be achieved within the larger interval.

The outlet system 100 of the present invention can advantageously be mounted on a vessel for treatment of lignocellulosic material, such as an impregnation vessel. The method of mounting the outlet system 100 comprises removing a bottom portion of a vessel and mounting an outlet system 100 on the vessel so that the bottom portion 1 of the outlet system 100 forms the bottom portion 1 of the vessel. Thereby, an existing vessel is modified so that the feeding of chip slurry towards the outlet is significantly improved and so that a pump can be connected instead of a rotary pocket feeder. The need for replacing the entire vessel is thereby eliminated and at the same time the above mentioned advantages are achieved, also providing a cost efficient improvement of an existing treatment vessel.

The outlet system according to the present invention is especially advantageous when the vessel in connection with which it is arranged serves to perform both steaming and impregnating of the lignocellulosic material, since the material is in such cases in the form of a fluid when being discharged through the outlet system. The outlet system is especially suited to transporting such fluid lignocellulosic material or slurry to be pumped.

It is to be noted that features from the various embodiments described herein may freely be combined, unless it is explicitly stated that such a combination would be unsuitable. In particular, when one feature of an embodiment has been stated as differing from other embodiments described above, it follows that other features of that embodiment may be similar to those of the other embodiments.

The invention claimed is:

1. An outlet system for transporting comminuted lignocellulosic material from a vessel, said outlet system comprising a bottom portion arranged in or at a bottom of the vessel, said bottom portion having an upper perimeter that is essentially circular and a lower perimeter comprising at least two essentially straight portions opposite each other, and wherein each of the essentially straight portions forms a base for a wedge-shaped surface on a lateral surface of the bottom portion, said wedge-shaped surface being planar and extending upwards to an upper wedge end at the upper perimeter, the outlet system further comprising a chip transfer arrangement that is joined to the lower perimeter and comprises sides that correspond to sides of the lower perimeter, the outlet system comprising an outlet unit that is joined to the chip transfer arrangement and that comprises an outlet that is configured to be connected via a connection portion of the outlet unit to a pump, wherein the outlet unit further has a circular cross-section, and the outlet system further comprising the pump that is connected to the outlet of the outlet system, wherein the pump includes a centrifugal pump, and wherein the lower perimeter is essentially rectangular in shape, comprising four essentially straight portions.

2. The outlet system according to claim 1, wherein said upper wedge end of at least one of the wedge-shaped surfaces is offset in a circumferential direction from a middle point on the base of the wedge-shaped surface.

3. The outlet system according to claim 1, wherein the wedge-shaped surfaces are at a first angle with respect to a plane that coincides with the essentially circular upper perimeter of the bottom portion, said first angle being equal to or less than 120 degrees.

4. The outlet system according to claim 1, wherein the lateral surface of the bottom portion comprises at least four wedge-shaped surfaces, each having one of the essentially straight portions as its base.

5. The outlet system according to claim 1, wherein the outlet unit comprises a conduit that connects the outlet to the outlet unit.

6. The outlet system according to claim 1, further comprising at least one nozzle arranged to supply a fluid into the outlet unit.

7. The outlet system according to claim 1, wherein the connection portion of the outlet unit extends in a first direction, the first direction making an angle with respect to a horizontal direction of +15° to −45°.

8. A vessel for treatment of comminuted lignocellulosic material, the vessel comprising an outlet system according to claim 1.

9. A method for modifying a vessel for treatment of comminuted lignocellulosic material, the method comprising removing a bottom portion from a vessel and connecting an outlet system according to claim 1 to the vessel.

10. The outlet system according to claim 3, wherein said first angle is less than 115 degrees.

11. The outlet system according to claim 7, wherein the first direction makes an angle with respect to a horizontal direction of +5° to −20°.

* * * * *